United States Patent [19]

Semon et al.

[11] Patent Number: 4,619,211

[45] Date of Patent: Oct. 28, 1986

[54] APPARATUS FOR PRODUCING SHIRRING

[75] Inventors: Joseph R. Semon; William J. Semon; Lawrence J. Bonczar, all of Eynon; Helen Ceresko, Mt. Cobb; William T. MacKirdy, Eynon, all of Pa.

[73] Assignee: Casket Shells, Inc., Eynon, Pa.

[21] Appl. No.: 526,408

[22] Filed: Aug. 25, 1983

[51] Int. Cl.[4] ..... D05B 35/08

[52] U.S. Cl. ..... 112/132; 112/322; 156/205

[58] Field of Search ..... 112/132, 133, 134, 135, 112/311, 322, 304; 156/205, 210, 206, 471, 473, 470; 223/28, 29, 30, 31-35; 28/279; 26/2 R, 1, 18.5, 22, 23, 25

[56] References Cited

U.S. PATENT DOCUMENTS

| | | | |
|---|---|---|---|
| 1,571,654 | 2/1926 | Tiedemann | 112/132 |
| 2,325,544 | 7/1943 | Redman | 26/18.5 |
| 2,669,954 | 2/1954 | Russell | 112/135 |
| 2,751,661 | 6/1956 | Shattuck | 28/279 |
| 3,025,194 | 3/1962 | Adams | 223/34 X |
| 3,133,516 | 5/1964 | Gorin et al. | 112/132 |
| 3,592,732 | 7/1971 | Wand | 26/1 X |
| 3,804,688 | 4/1974 | Hillenbrand et al. | 112/132 |
| 3,877,118 | 4/1975 | Misenheimer et al. | 26/2 R |
| 3,954,071 | 5/1976 | Mall et al. | 112/311 |
| 4,466,367 | 8/1984 | Price et al. | 112/134 |

FOREIGN PATENT DOCUMENTS

| | | | |
|---|---|---|---|
| 505697 | 3/1952 | France | 26/1 |
| 645062 | 6/1962 | Japan | 28/279 |
| 239137 | 3/1969 | U.S.S.R. | 26/1 |

*Primary Examiner*—Werner H. Schroeder
*Assistant Examiner*—Andrew M. Falik
*Attorney, Agent, or Firm*—Kane, Dalsimer, Kane, Sullivan and Kurucz

[57] ABSTRACT

A panel of fabric is guided from a spool to a gathering device. The gathering device includes a spindle located above and across the width of the panel of fabric and having a plurality of spaced apart wheels attached thereto. Extending radially from the wheels are a plurality of flexible mechanical fingers, or alternately, flexible bristles. As the wheels rotate the flexible projections gather the fabric into folds. A panel of backing material is guided to underlay the gathered fabric. The gathered fabric is then adhered to the backing material. A means for conveying the fabric and backing material is also provided.

9 Claims, 6 Drawing Figures

FIG 5
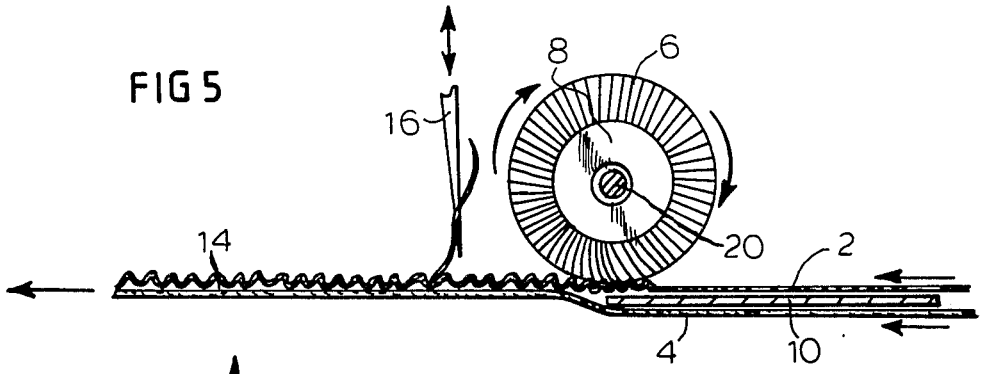
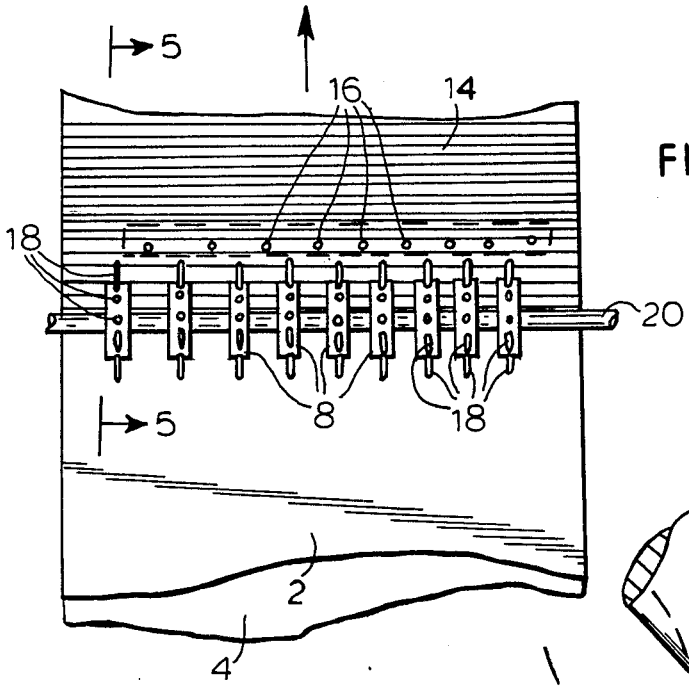
FIG.4
FIG.1
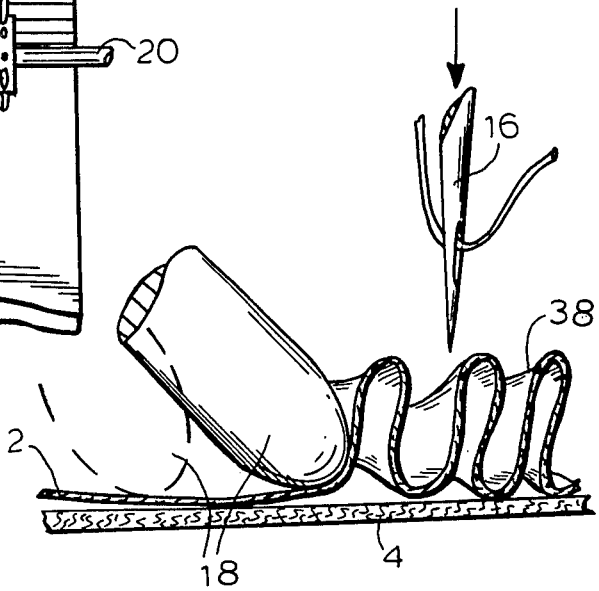
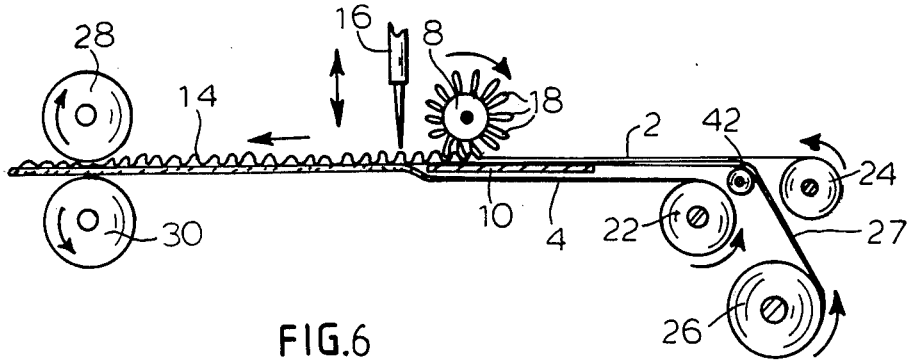
FIG.6

FIG. 2
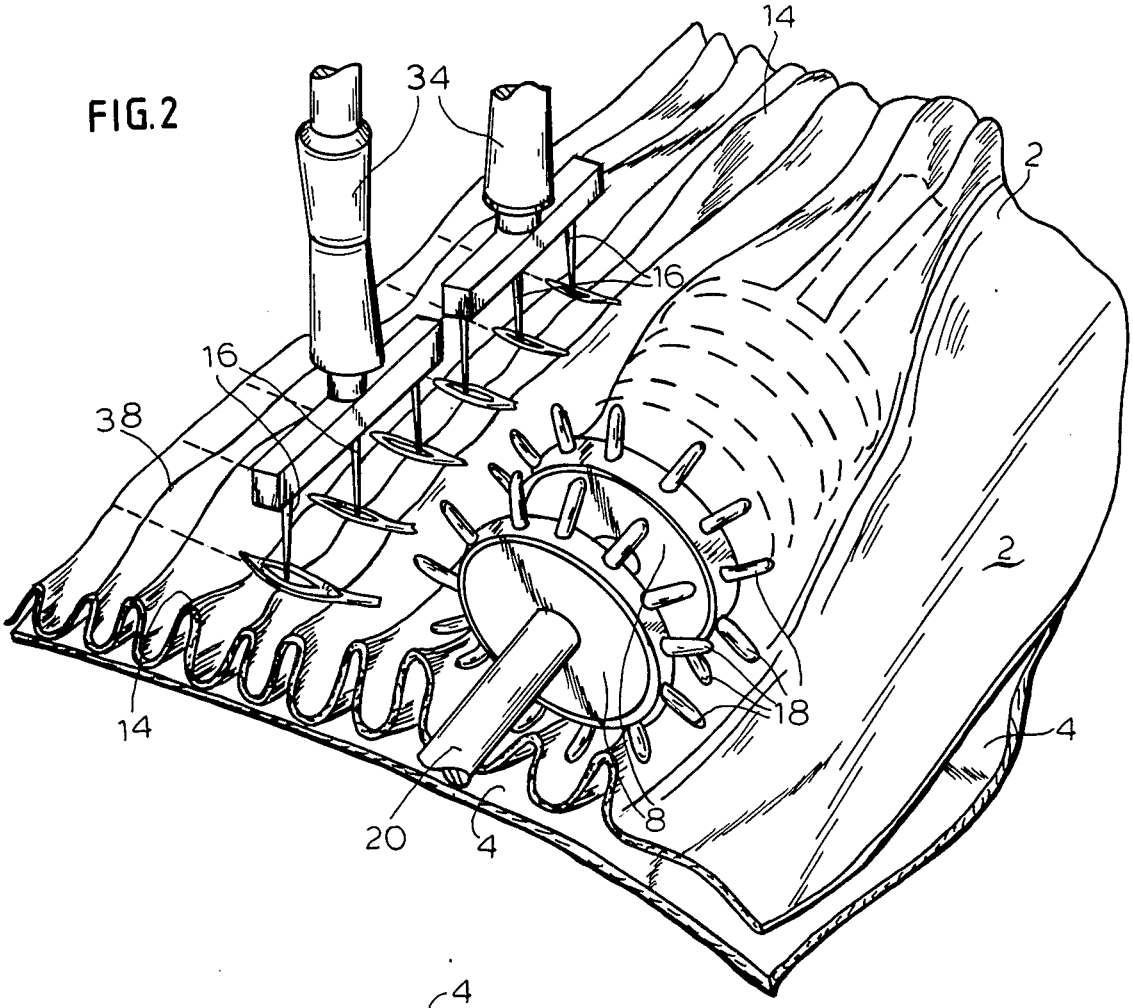
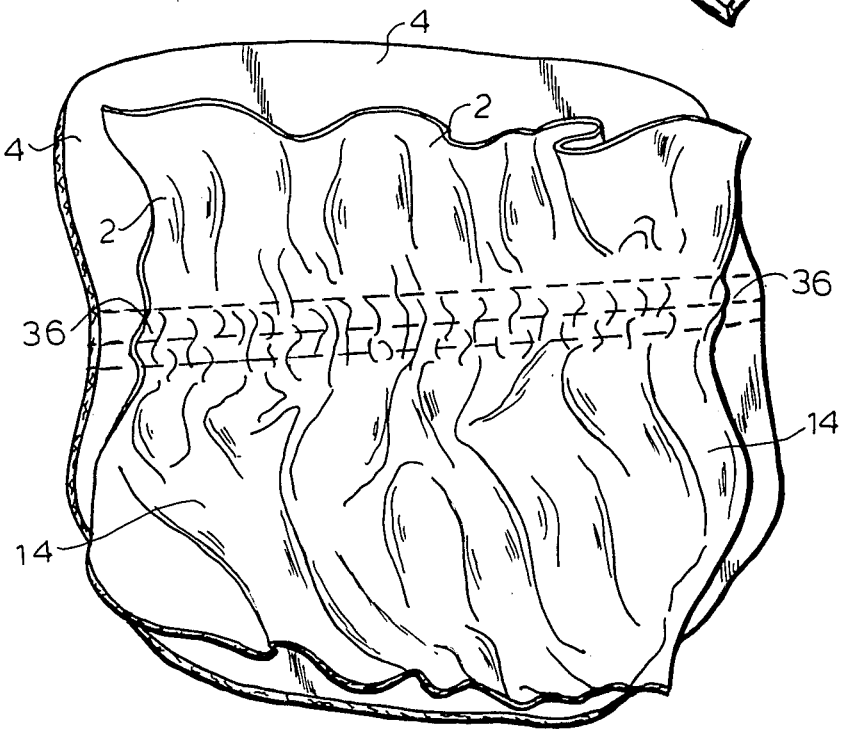
FIG. 3

APPARATUS FOR PRODUCING SHIRRING

BACKGROUND OF INVENTION

This invention pertains to a method and an apparatus for producing shirring.

Shirring has been used in the casket industry to decorate caskets and to create a pleasing casket appearance. Various methods of producing shirring have been employed. The earliest method involved threading an elastic band through spaced apertures in fabric, the elastic gathering the fabric into folds.

To provide more efficient production an improved method was developed wherein operators push a top layer of fabric into folds with their fingers while guiding the panel of fabric, underlain by backing material, to sewing needles which sew the gathered fabric to the backing material. This operator method has been used for the bulk of the shirring production to date.

As labor costs have risen the demand for automated production methods has increased. Additional drawbacks to the operator method have also become apparent. The constant attention of an operator is required. The task is unduly repetitive. Errors and imperfections are frequent, in large part due to the repetitive character of the work. In addition production rates are limited by the capacity of an operator to handle the material.

An increase in the demand for shirring has created a need for more efficient production methods. In response to this need devices which produce shirring automatically have, been attempted, e.g. U.S. Pat. No. 3,804,688. As disclosed in that patent a corrugated wheel engages an adjacent corrugated wheel thereby folding a panel of fabric which is fed between the teeth of the two wheels. This crush folded fabric is then adhered to a backing material. The resulting product has the appearance of a corrugated fabric rather than that of naturally gathered shirring. Due to the inability of the industry to develop a satisfactory automatic shirring device the operator method has continued to be the primary method of producing shirring despite its repetitive character and cost inefficiencies.

SUMMARY OF THE INVENTION

This invention provides a method and apparatus for automatically producing shirring by simulating the manual gathering of fabric done by sewing machine operators.

A panel of fabric is guided from a spool to a gathering device. The gathering device includes a spindle, located above and across the width of the panel of fabric, having a plurality of spaced apart wheels attached thereto. Extending radially from the wheels are a plurality of flexible mechanical fingers, or alternately, flexible bristles. As the wheels rotate the flexible projections gather the fabric into folds. A panel of backing material is guided to underlay the gathered fabric. The gathered fabric is then adhered to the backing material. A means for conveying the fabric and backing material is also provided.

The primary object of the present invention is to provide a method and an apparatus for automatically producing shirring having a traditional naturally gathered appearance. The method and apparatus provided produce shirring rapidly and efficiently. Labor and production costs are eliminated and the demand in the industry for inexpensive, aesthetically appealing shirring is met.

Another object of the present invention is to provide a device which mechanically simulates the use of a sewing machine operator's fingers to gather fabric and to push it into folds so that the problem of automatically producing an aesthetically pleasing shirring product is overcome.

A still further object of the present invention is to provide a method and apparatus for producing shirring which is designed to minimize errors and imperfections by eliminating the former need for an operator to constantly administer an unduly repetitive production operation.

An additional object of the present invention is to provide a method and apparatus for producing shirring wherein the size and shape of the folds may be varied as desired by adjusting the location, rotational speed, and the size of the flexible mechanical projections of the gathering means.

These and other objects and advantages will become apparent from the following detailed description which is to be taken in conjunction with the accompanying drawings.

BRIEF DESCRIPTION OF THE DRAWINGS

FIG. 1 is an enlarged view of a flexible mechanical finger gathering fabric into folds at the sewing needle.

FIG. 2 is a perspective view of the present invention gathering and sewing fabric to a backing material.

FIG. 3 is a plan view of a section of shirring produced by the present invention.

FIG. 4 is a plan view of the present invention in operation.

FIG. 5 is a side view of an alternate embodiment of the present invention in operation taken along line 5—5 of FIG. 4 the embodiment of FIG. 5 differing from FIG. 4 only in that bristles are shown rather than the projection of FIG. 4.

FIG. 6 is a side view of the present invention additionally illustrating the feeding and drawing means.

DETAILED DESCRIPTION OF THE PREFERRED EMBODIMENT

FIG. 5 illustrates a method and an apparatus for producing shirring. Fabric 2, which may be any suitable decorative material, e.g. velvet, acetate, etc, is conveyed from spool 24 (see FIG. 6) to the top surface of guiding plate 10, then to the gathering apparatus. The gathering apparatus includes spindle 20 and wheels 8 having bristles 6 or, alternatively, mechanical fingers 18, illustrated in perspective in FIG. 2.

Wheels 8 are affixed to spindle 20 which may be driven by any conventional drive means, e.g. a belt or drive chain driven by an electric motor. The rate of rotation, the location, and the number of wheels 8 may be varied to adjust the number and shape of the folds in the shirring produced.

During production, wheel 8 rotates bringing the end of bristle 6 into contact with fabric 2. Pressure applied by bristle 6 on fabric 2 increases as bristle 6 bends, pushing fabric 2 at the point of contact into fold 38. As wheel 8 continues to rotate bristle 6 is removed from contact with fabric 2. As shown in FIG. 1, the invention utilizes fingers 18 that operate in a fashion to mechanically simulate manual finger gathering operation of a sewing machine operator. FIG. 6 illustrate the use of a flexible mechanical finger 18 to gather fabric 2 according to an alternative preferred embodiment. Gathered fabric 2 is underlain by backing material 4 which has been conveyed from spool 22 to the underside of guiding plate 10 then to sewing needle 16.

The backing material may be any suitable, preferably inexpensive, material which has sufficient strength to support fabric sewn therethrough. The gathered fabric 2 is then sewn to the backing material 4 producing shirring 14. The sewing must occur while the fabric is in a gathered state, thus the sewing means should be located very close to the gathering means.

In the preferred embodiment the means for adhering fabric to the backing material is a sewing means, however a means for adhering fabric to backing material may be used wherein a thermoplastic layer on the fabric is melted, followed by pressing of the fabric to the backing material creating a thermoplastic bond therebetween.

FIG. 6 illustrates a conveying means having upper and lower drawing wheels 28 and 30 which are sufficiently close together so that when upper drawing wheel 28 turns clockwise and lower drawing wheel 30 turns counterclockwise the pressure applied to shirring 14 is sufficient to pull it therethrough thereby conveying fabric 2 and backing material 4 through the aforesaid guiding, gathering and sewing steps. Upper and lower drawing wheels 28 and 30 may be driven by any conventional drive means, e.g. a belt or drive chain driven by an electric motor. An alternative conveying means comprises individual belt or chain conveyors for the fabric and backing material.

It may be found desirable to use roller guides in addition to guide plate 10 to achieve optimum control for the gathering and sewing of panels of fabric and backing.

FIG. 2 illustrates the gathering and sewing steps from a perspective view. Wheels 8 are spaced apart and attached to spindle 20 which extends across the width of fabric 2. Fabric 2 is gathered in folds extending across the width of the panel and is conveyed to sewing means 34 having a plurality of needles 16 which sew fabric 2 to backing material 4 creating a plurality of parallel lines of stitching 36 along the length of the panel of shirring 14. Thus the shirring produced 14 comprises a panel of backing material 4, and a panel of fabric 2 gathered into folds by flexible mechanical projections and sewn to the backing material.

FIG. 6 illustrates the present invention including a layer of wadding material 27 which is used to produce thicker shirring. Wadding material 27 is conveyed from spool 26 to roller guide 42, then to the top of guide plate 10 so that it underlays fabric 2. It is then conveyed to the gathering means and to sewing means 34 where it is sewn between fabric 2 and backing 4. Wadding material 27 is conveyed by being drawn through drawing wheels 28 and 30. (FIG. 6). The shirring thus produced comprises a panel of backing, a panel of wadding sewn thereto, and a panel of gathered fabric sewn thereto.

What is claimed is:

1. An apparatus for producing shirring which comprises:

a guiding means adapted to guide a panel of backing material to an adhering means so as to underlay fabric with backing material at the adhering means;

the adhering means located to receive fabric as it is conveyed from the guiding means;

a gathering means comprising a plurality of flexible mechanical projectons which automatically push fabric into folds, the guiding means being a guiding plate disposed below the gathering means and the gathering means comprising a movable support having the flexible mechanical projections extending therefrom wherein the flexible mechanical projections each having a substantially equal determined length and wherein the movable support being spaced a predetermined distance from the guide plate, the predetermined distance being slightly less than the predetermined length of the flexible mechanical projections so that during operation of the invention of the flexible mechanical projections contact fabric passing over the guide plate, and the flexible mechanical projections being bent by pressure from the guide plate and resultant pressure from the flexible mechanical projections on the fabric acts to press and push the fabric into folds;

a conveying means adapted to convey the panel of fabric and the panel of backing material whereby fabric and backing material pass the guiding means, gathering means, and the adhering means.

2. The invention in accordance with claim 1 wherein the adhering means is a sewing device.

3. The invention in accordance with claim 1 wherein the gathering means further comprises:

a plurality of spaced apart wheels attached to a spindle located so as to extend across the width of a conveyed panel of fabric, each wheel having a plurality of flexible mechanical fingers extending therefrom.

4. The invention in accordance with claim 1 wherein the gathering means further comprises:

a spindle, located so as to extend across the width of a conveyed panel of fabric, having a plurality of spaced apart wheels each wheel having a multiplicity of flexible bristles extending therefrom.

5. The invention in accordance with claim 1 wherein the guiding means further comprises:

a plate located to receive conveyed fabric on its top surface and backing material on its bottom surface so that fabric is gathered and conveyed to the sewing means, and so that backing material is conveyed from the plate to the sewing means.

6. The invention in accordance with claim 1 wherein the conveying means comprises an upper and lower mechanically driven drawing wheel located so as to receive and draw therethrough a panel of shirring.

7. The invention in accordance with claim 2 further comprising:

a source of backing material, a source of wadding material and a source of fabric wherein the guiding means comprises a guiding plate which guides the wadding material, the backing material and the fabric so that wadding material is positioned between fabric and backing material at the sewing means and sewn therebetween; and wherein the conveying means is further adapted to convey a panel of wadding material so that wadding material passes the guiding and sewing means.

8. The invention in accordance with claim 1 wherein the flexible mechanical projections are elongated fingers.

9. The invention in accordance with claim 1 wherein the flexible mechanical projections are bristles.

* * * * *